US007744088B2

(12) United States Patent
Tseng

(10) Patent No.: US 7,744,088 B2
(45) Date of Patent: Jun. 29, 2010

(54) AUTOMATIC DICE SHAKING METHOD

(76) Inventor: Tzu-Hsiang Tseng, 15F., No. 367, Sec. 4, Hankou Rd., North District, Taichung City (TW) 404

( * ) Notice: Subject to any disclaimer, the term of this patent is extended or adjusted under 35 U.S.C. 154(b) by 122 days.

(21) Appl. No.: 12/285,722

(22) Filed: Oct. 14, 2008

(65) Prior Publication Data

US 2010/0090398 A1 Apr. 15, 2010

(51) Int. Cl.
*A63F 9/04* (2006.01)

(52) U.S. Cl. ..... 273/145 C; 273/145 R; 273/145 A; 273/138.2; D21/372; 463/22

(58) Field of Classification Search ..... 273/145 C, 273/145 CA, 145 R, 145 A, 138.2; D21/372; 463/22

See application file for complete search history.

(56) References Cited

U.S. PATENT DOCUMENTS 491,971 A * 2/1893 Williams et al. ..... 194/276
1,054,694 A * 3/1913 Langsworth ..... 273/145 A
3,684,291 A * 8/1972 Johmann ..... 273/145 R
3,831,948 A * 8/1974 Suda ..... 273/145 R
4,807,883 A * 2/1989 Silverman ..... 273/145 C
5,259,618 A * 11/1993 Ramos ..... 273/145 C
7,185,889 B2 * 3/2007 VanZanten ..... 273/274
2007/0090595 A1 * 4/2007 Csikos ..... 273/149 R
2009/0036187 A1 * 2/2009 Tseng ..... 463/13
2009/0264186 A1 * 10/2009 Lai et al. ..... 463/22

OTHER PUBLICATIONS

Taiwan Fulgent Ent. Co., Ltd., RobotCasino, http://www.robotcasino.com.tw, picked up brochure at Global Gaming Expo in Las Vegas, NV on Sep. 13, 2005.*

* cited by examiner

*Primary Examiner*—Benjamin H Layno
(74) *Attorney, Agent, or Firm*—Bacon & Thomas, PLLC

(57) ABSTRACT

A automatic dice shaking method includes the step of a) positioning a dice seat of a dice box on a plane, b) joining a dice cup of the dice box to the dice seat, c) shaking the dice box in which a plurality of dice are contained, d) positioning the dice seat with which the dice cup is joined on the plane, and e) separating the dice cup from the dice seat. By means of controlling a computer-controlled mechanical arm to run dice shaking and dice cup separating actions automatically, the automatic dice shaking method improves game fairness and helps reduce the personnel cost.

7 Claims, 12 Drawing Sheets

AUTOMATIC DICE SHAKING METHOD

BACKGROUND OF THE INVENTION

1. Field of the Invention

The present invention relates generally to dice gambling and more particularly, to an automatic dice shaking method.

2. Description of the Related Art

Dice are small objects, usually cubic, used for generating random numbers for use in tabletop games. Many dice games are known. In one known dice game, players bet on the banker, and the banker puts the dice in a dice box and shakes the dice. After betting, the banker opens the dice cup and pays the dividends subject to the gambling result.

However, performing dice games may encounter some problems as follows:

1. Because all actions, such as dice shaking, dice box opening, and etc., during a dice game are done manually, a dealer may control the points of the dice by means of a manipulation skill or have the points expected by the banker to appear by means of the control of the muscular strength of the hand shaking the dice. Therefore, a conventional manual dice shaking operation cannot prevent cheating, lacking objective fairness.

2. There are automatic dice shakers for shaking dice automatically to ensure game fairness. However, these automatic dice shakers cannot perform a dice box opening procedure automatically. Because the opening of the dice cup must be performed manually, cheating may exist. Playing a dice game in this manner still lacks fairness.

3. Because a person is hired to shake the dice and to open the dice cup during a dice game, the personnel cost is relatively increased.

Therefore, it is desirable to provide an automatic dice shaking method that eliminates the aforesaid problems.

SUMMARY OF THE INVENTION

The present invention has been accomplished under the circumstances in view. It is one objective of the present invention to provide an automatic dice shaking method, which can automatically shake the dice and open the dice cup by means of a computer-controlled mechanical arm, improving the game fairness.

It is another objective of the present invention to provide an automatic dice shaking method, which utilizes a computer-controlled mechanical arm to automatically shake the dice and open the dice cup instead of human labor, thereby lowering the personnel cost.

To achieve these objectives of the present invention, the automatic dice shaking method comprises: a) dice seat positioning step, where a dice seat of a dice box is detachably positioned on a plane and a plurality of dice are placed on the dice seat in a fully exposed manner, b) dice box joining step, where a mechanical arm is controlled to detachably join a dice cup of the dice box to the dice seat for enabling the joined dice seat and dice cup to be moved together by the mechanical arm, c) dice shaking step, where the mechanical arm is controlled to carry the dice box away from the plane and to shake the dice in the dice box, d) dice seat positioning step, where the mechanical arm is operated to move the dice box to the plane and to have the dice seat be detachably positioned on the plane, and e) dice box opening step, where the mechanical arm is operated to separate the dice cup from the dice seat and to have the dice be exposed at the dice seat, thereafter enabling a next dice shaking round to be started from the step b).

Preferably, the dice cup is secured to a front end of the mechanical arm and then moved with the mechanical arm for joining to the dice seat in step b).

Preferably, the mechanical arm includes means for catching the dice cup to join the dice cup to the dice seat in step b).

Preferably, the dice cup is joined to the dice seat by means of one of a screw joint and a clamp joint in step b).

Preferably, the mechanical arm is operated to rotate the dice cup so as to move the dice cup into engagement with the dice seat in step b).

Preferably, the mechanical arm is operated to rotate the dice cup so as to separate the dice cup from the dice seat in step e).

Preferably, the method of the present invention further comprises a step of reading the points of the dice by a recognition apparatus after the dice are exposed at the dice seat in step e).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
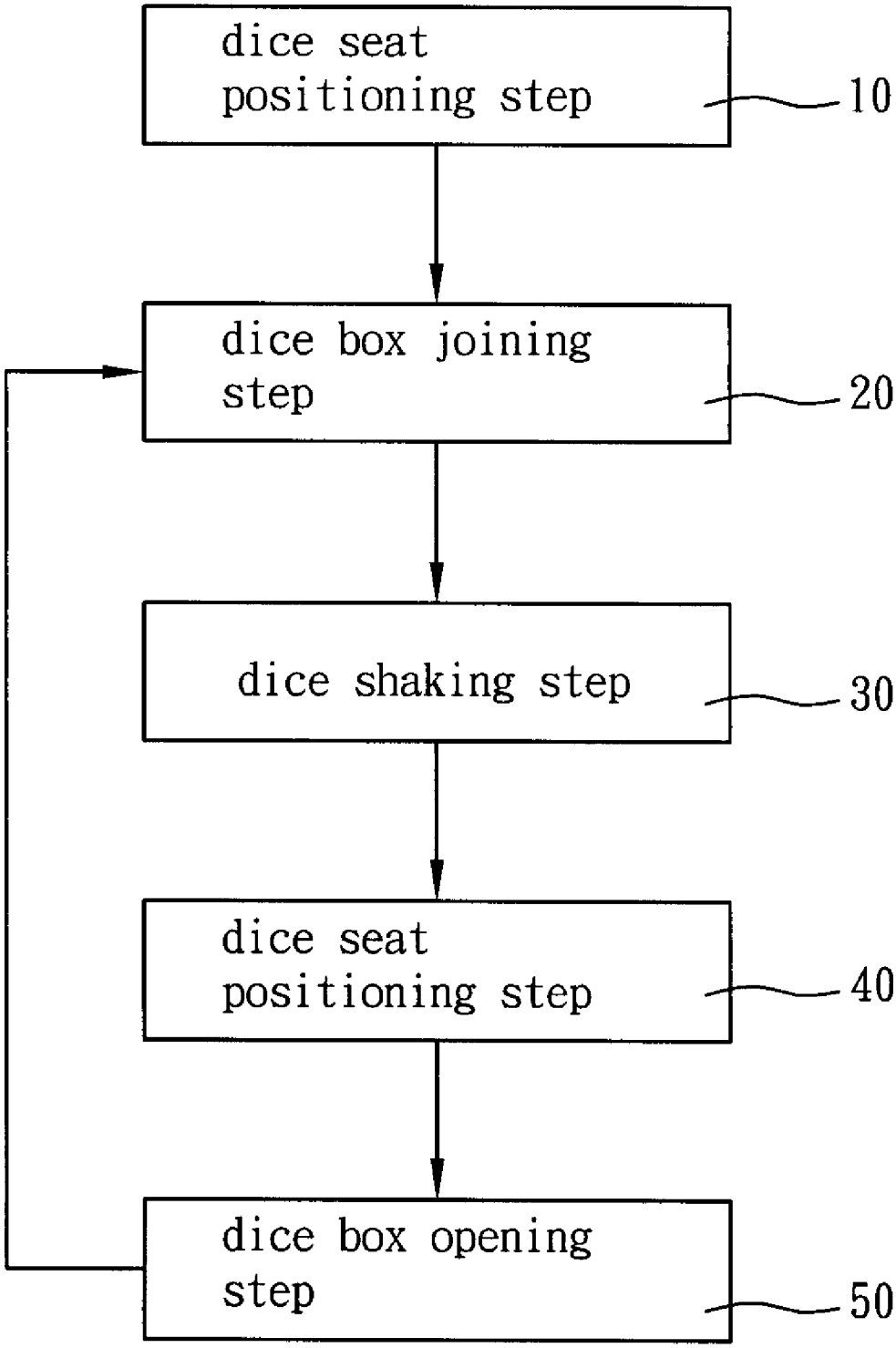
FIG. 1 is a dice shaking method flow chart according to the present invention.

As shown in FIG. 1, an automatic dice shaking method in accordance with an exemplary embodiment of the present invention comprises: a) dice seat positioning step 10, b) dice box joining step 20, c) dice shaking step 30, d) dice seat positioning step 40 and e) dice box opening step 50.

Figure 2:
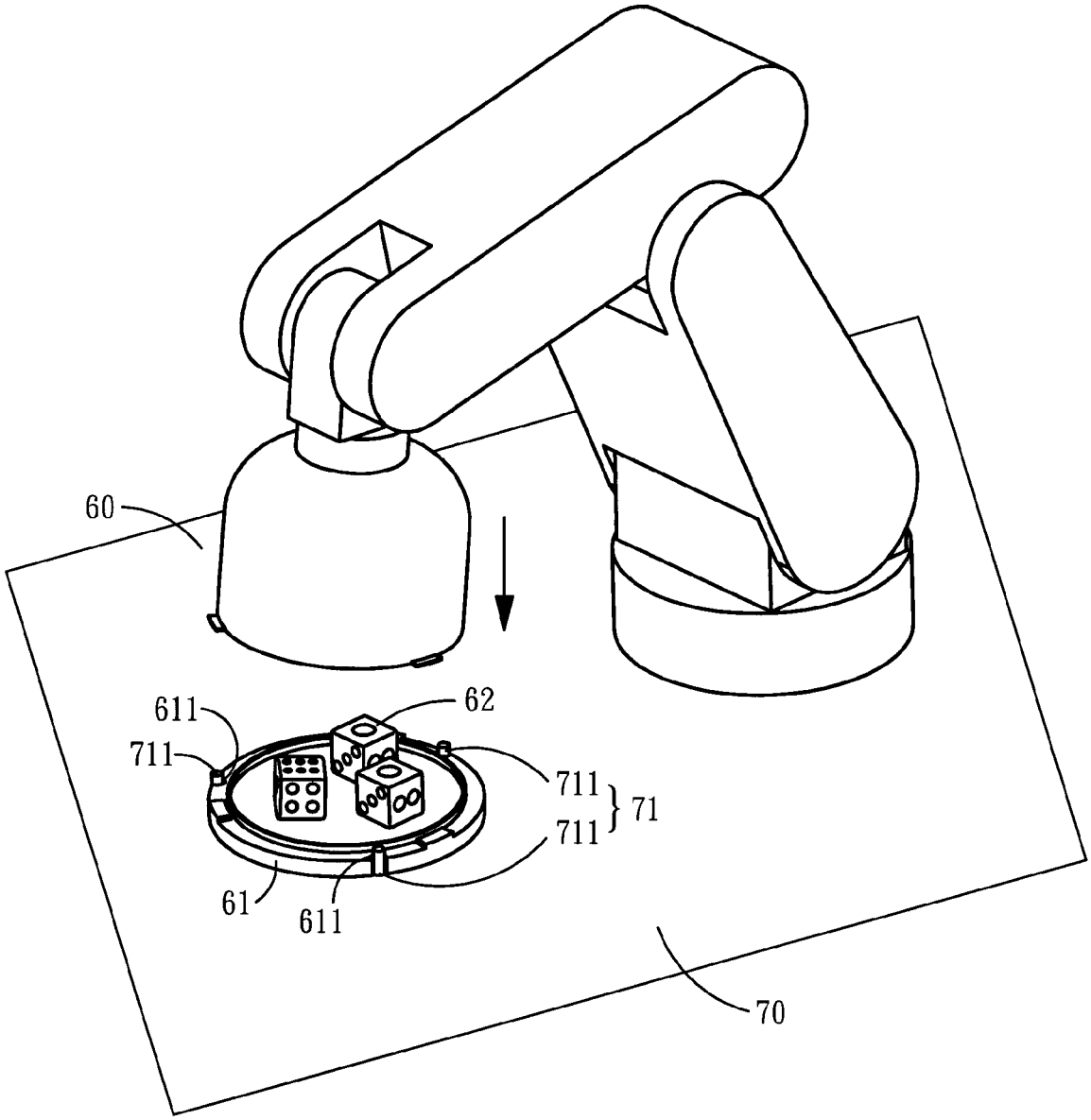
FIG. 2 is a schematic drawing illustrating that the dice seat is positioned on the plane in the dice seat positioning step a)
Figure 3:
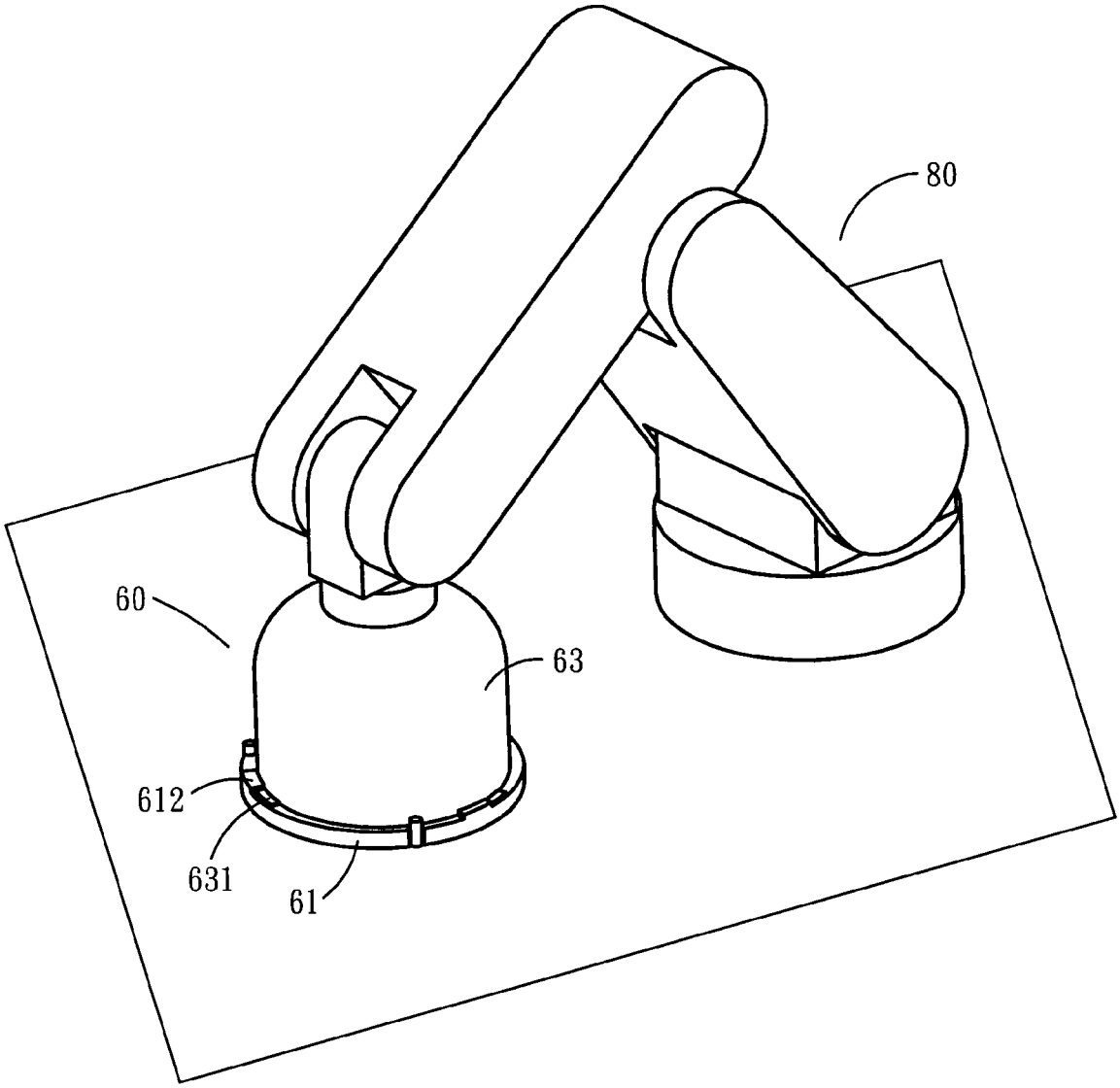
FIG. 3 is a schematic drawing illustrating that the dice cup is placed on but not engaged with the dice seat in the dice box joining step b)
Figure 4:
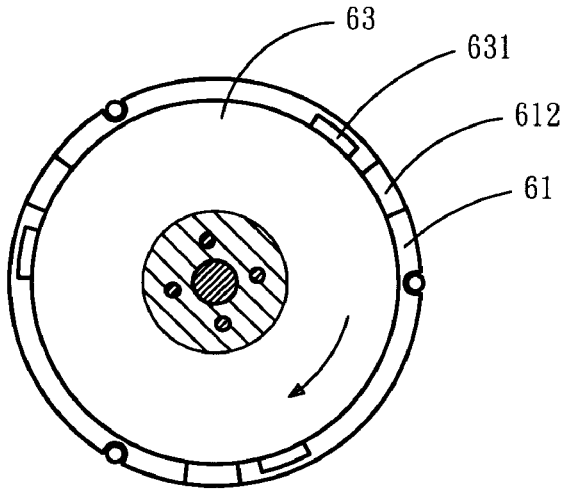
FIG. 4 is another schematic drawing illustrating that the dice cup is placed on but not engaged with the dice seat in the step b)
Figure 5:
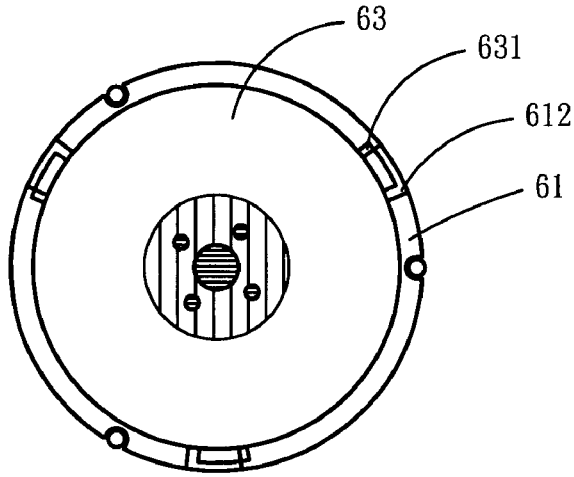
FIG. 5 is a schematic drawing illustrating that the dice cup is engaged with the dice seat in the step b)
Figure 6:
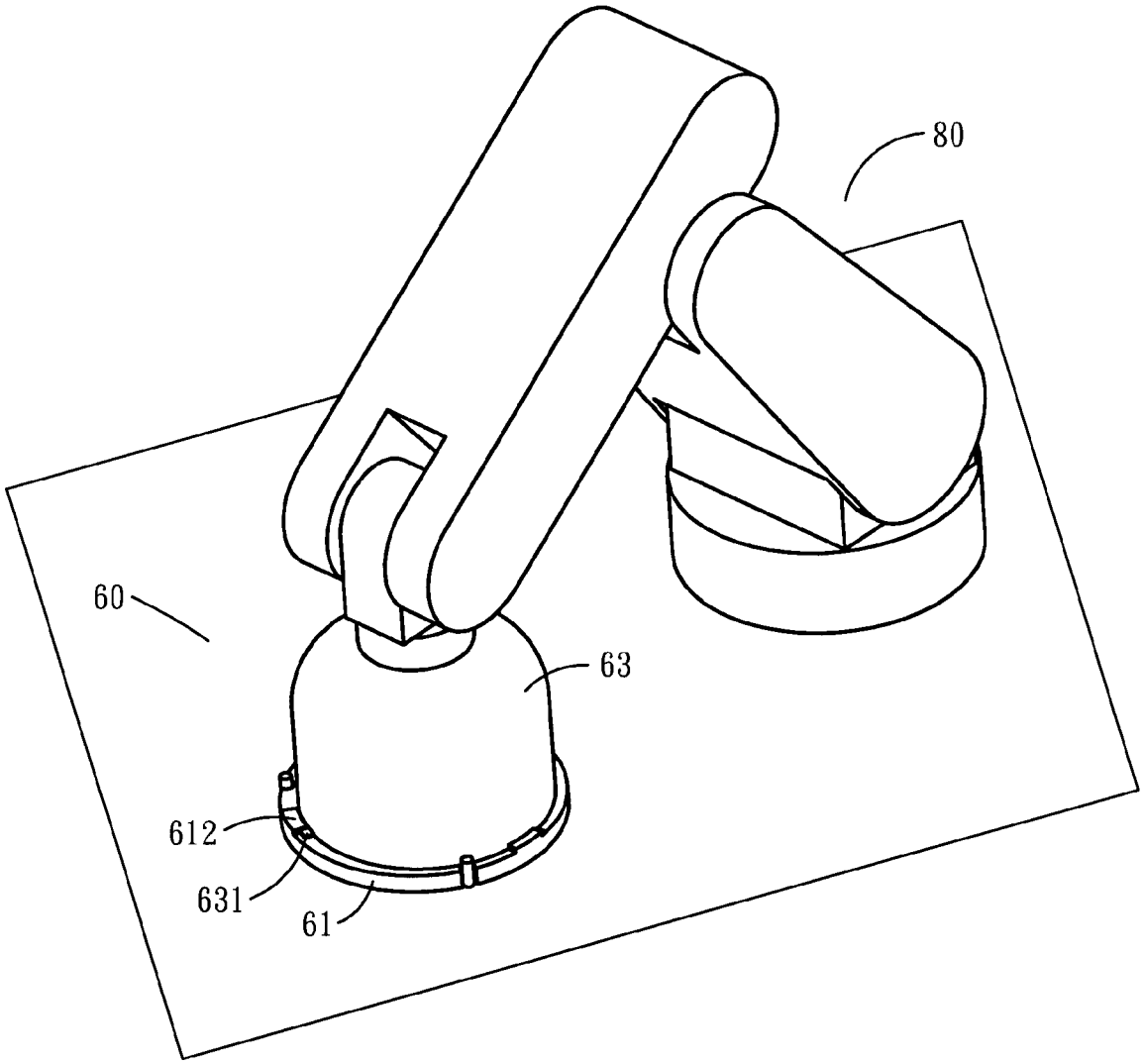
FIG. 6 is another schematic drawing illustrating that the dice cup is engaged with the dice seat in the step b)

In a) dice seat positioning step 10, as shown in FIG. 2, a dice seat 61 of a dice box 60 is detachably positioned on a plane 70, and dice 62 are placed on the dice seat 61 and fully exposed for check by players. According to the present invention, a positioning unit 71 is provided at the plane 70. The positioning unit 71 comprises three upright pins 711 equiangularly arranged on the plane 70. The dice seat 61 has three positioning grooves 611 equiangularly spaced around the periphery corresponding to the three upright pins 711. By means of coupling the three positioning grooves 611 to the three upright pins 711, the dice seat 61 is positioned on the plane 70 and prohibited from rotation relative to the plane 70. The upright pins 711 can guide the movement of the dice seat 61 in vertical. When the dice seat 61 is vertically upwardly moved over a predetermined distance, it is disconnected from the upright pins 711. Therefore, the dice seat 61 can be moved away from the positioning unit 71 and the positioning plane 70 vertically.

In b) dice box joining step 20, as shown in FIGS. 3-6, a mechanical arm 80 is controlled to detachably join a dice cup 63 of the dice box 60 to the dice seat 61. When the dice cup 63 and the dice seat 61 are joined together, they can be shaken by the mechanical arm 80 and will not detach from each other during shaking. According to the present preferred embodiment, the dice cup 63 is fastened to the front end of the mechanical arm 80 in advance so that the dice cup 63 is moved to change its position subject to the action of the mechanical arm 80. The dice cup 63 can be fastened to the front end of the mechanical arm 80 by means of, but not limited to, a screw joint, anchor joint or tongue and groove joint. The aforesaid statement explains connection between the dice cup 63 and the mechanical arm 80. Alternatively, the mechanical arm 80 can be designed having catch means at the front end such that, after catching the dice cup 63, the mechanical arm 80 can make predetermined actions steadily such as shaking the dice cup 63 or joining the dice cup 63 to the dice seat 61.

It is to be understood that the dice cup 63 can be joined to the dice seat 61 by means of a screw joint, tongue and groove joint or any other known techniques. According to the present preferred embodiment, the dice cup 63 is joinable to the dice seat 61 by means of an engagement structure. More specifically, when the dice cup 63 is placed on the dice seat 61 by the mechanical arm 80, the mechanical arm 80 is operated to rotate the dice cup 63, forcing a male engagement unit 631 of the dice cup 63 into engagement with a female engagement unit 612 of the dice seat 61. When the dice seat 61 and the dice cup 63 are joined together, they can be shaken by the mechanical arm 80 and will not disconnect from each other during shaking. According to the present preferred embodiment, the male engagement unit 631 of the dice cup 63 comprises a plurality of retaining blocks radially protruded from and equiangularly spaced around the periphery of the dice cup 63, and the female engagement unit 612 of the dice seat 61 comprises a plurality of retaining grooves corresponding to the retaining blocks of the male engagement unit 631 of the dice cup 63. When the dice cup 63 is placed on the dice seat 61 and rotated through an angle, the male engagement unit 631 is forced into engagement with the female engagement unit 612, and thus the dice cup 63 and the dice seat 61 are joined together.

Figure 7:
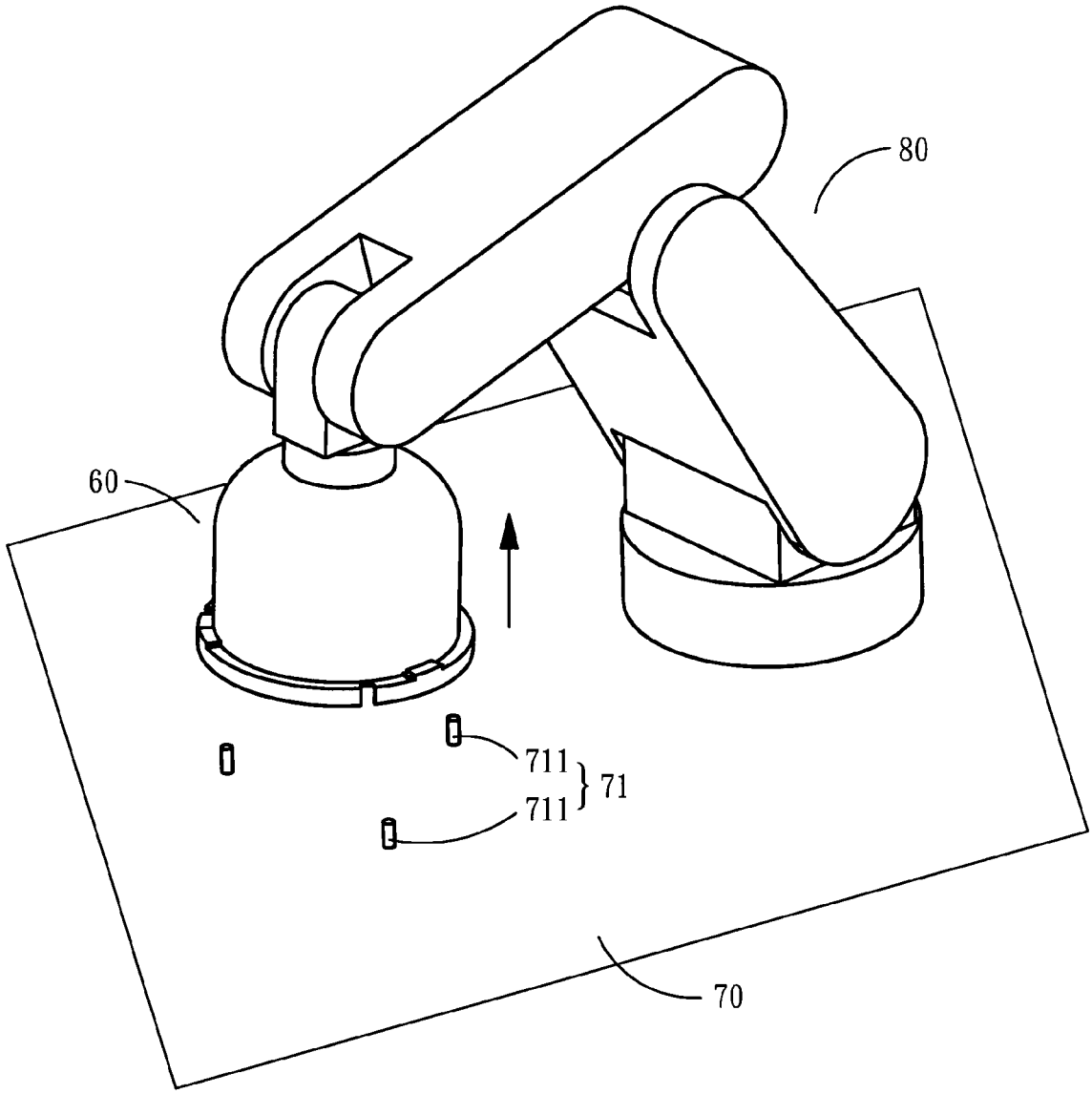
FIG. 7 is a schematic drawing illustrating that the dice box is moved with the mechanical arm away from the plane in the dice shaking step c)
Figure 8:
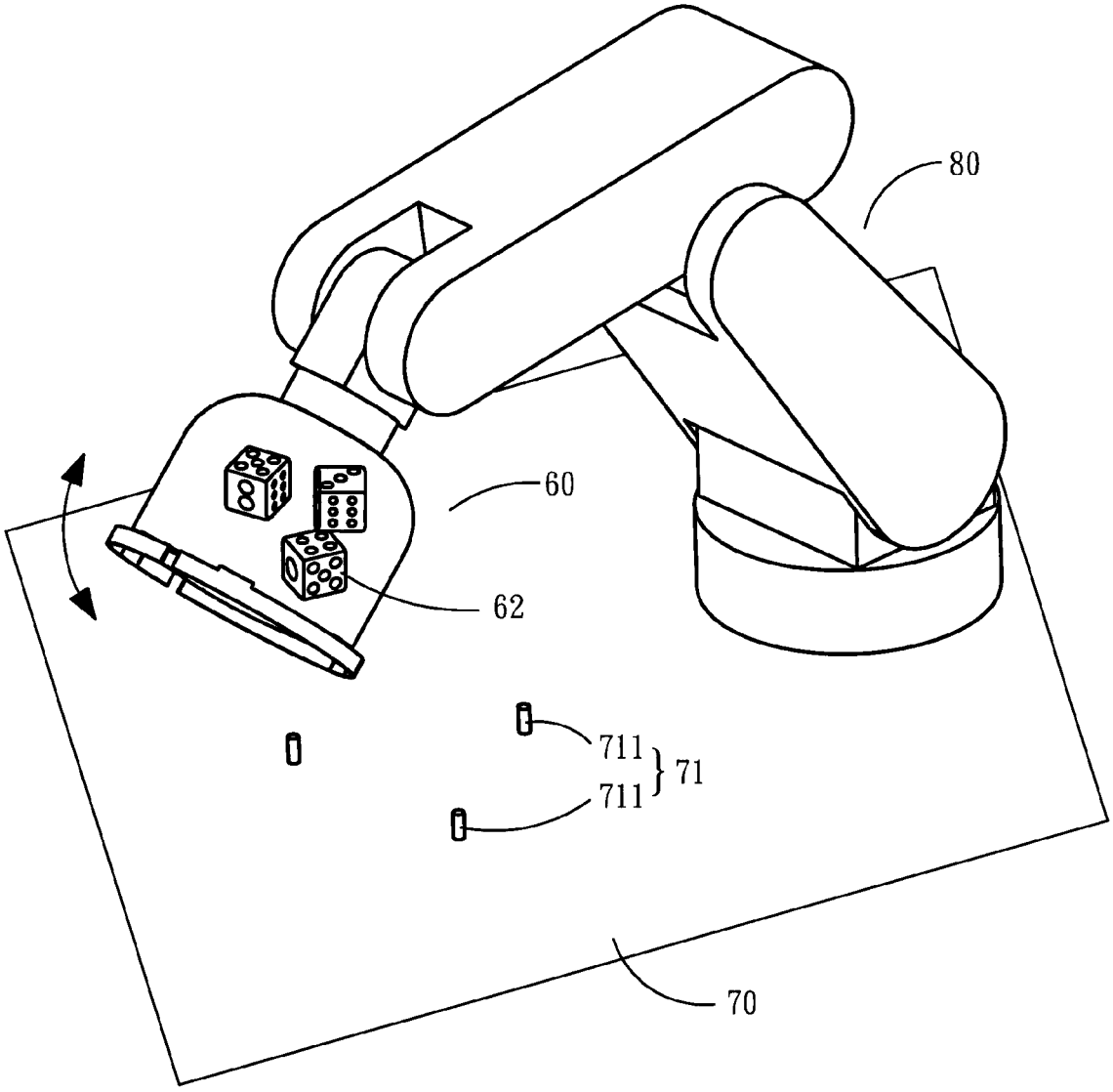
FIG. 8 is a schematic drawing illustrating that the mechanical arm is moved and the dice are shaken in the dice box in the dice shaking step c)

In c) dice shaking step 30, as shown in FIGS. 7 and 8, the mechanical arm 80 is controlled to carry the dice box 60 away from the plane 70 for further shaking operation to shake the dice 62 in the dice box 60. More specifically, the mechanical arm 80 carries the dice cup 63 and dice seat 61 of the dice box 60 upwardly away from the plane 70 and the upright pins 71 to an elevation where the dice box 60 can be shaken by the mechanical arm 80 without touching the plane 70 or upright pins 71. Further, the motion path of the mechanical arm 80 is a simulation of a human arm oscillation action subject to the control of a computer so that the shaking of the dice box 60 mimics a human's dice shaking action.

Figure 9:
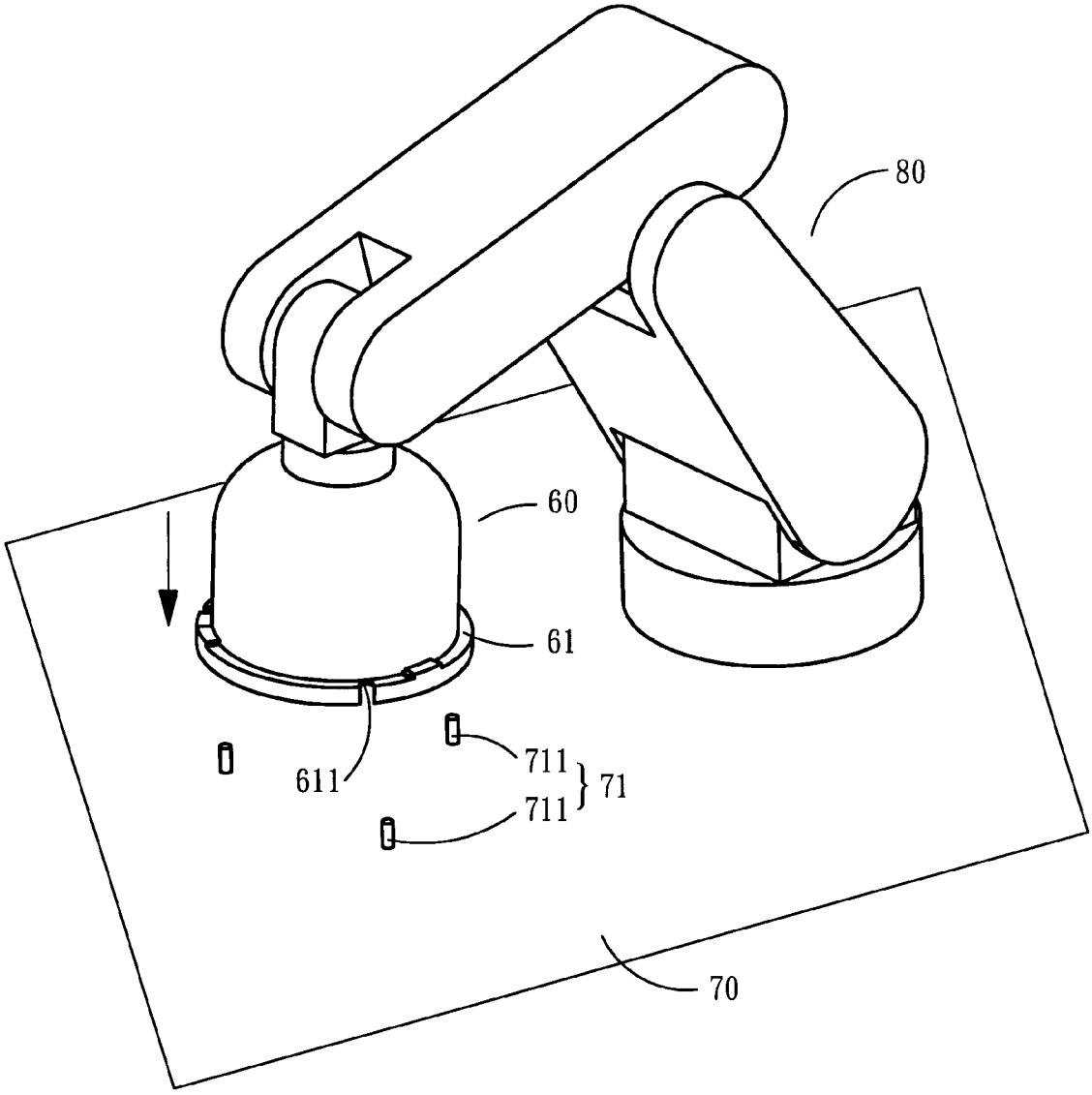
FIG. 9 is a schematic drawing illustrating that the dice box is moved downwards with the mechanical arm toward the plane after shaking in the dice seat positioning step d)
Figure 10:
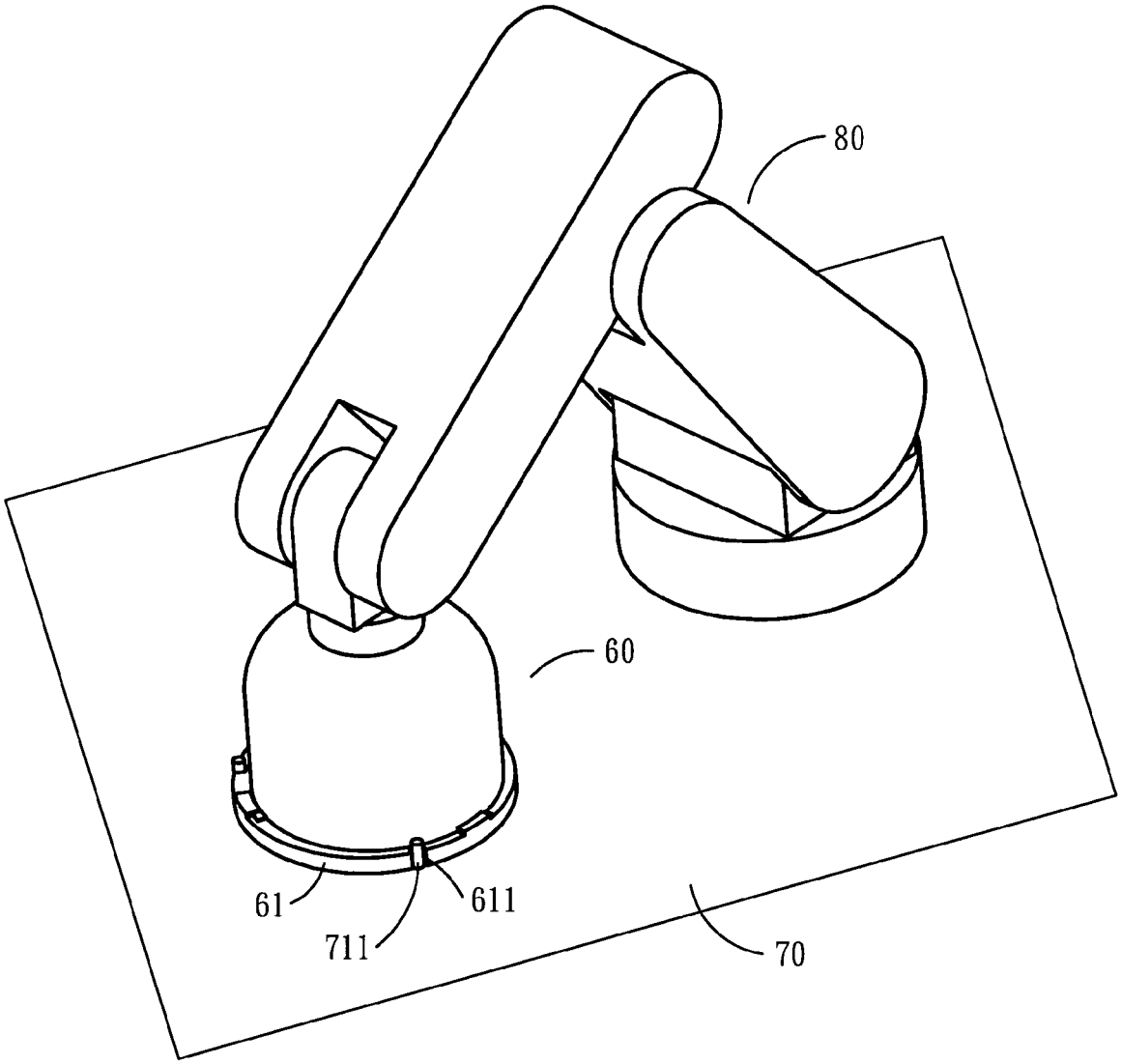
FIG. 10 is a schematic drawing illustrating that the dice box is positioned on the plane after shaking in the dice seat positioning step d)
Figure 11:
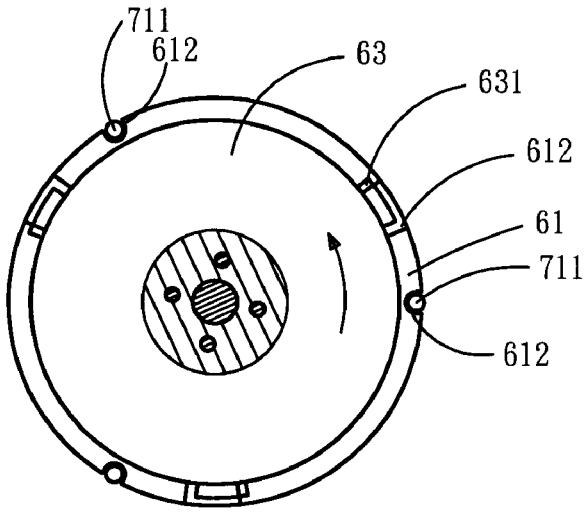
FIG. 11 is a schematic drawing illustrating that the dice cup is engaged with the dice seat in the dice box opening step e)
Figure 12:
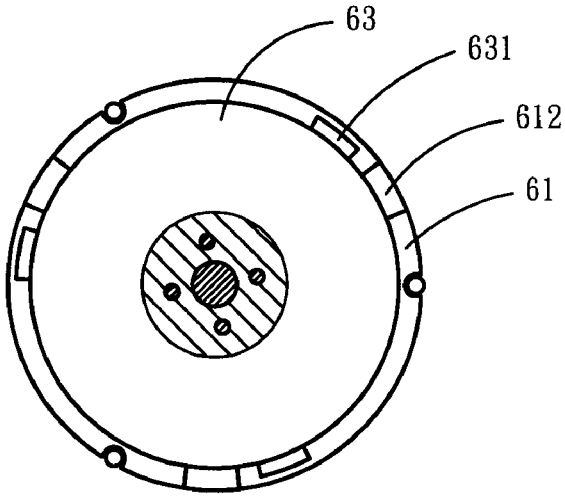
FIG. 12 is a schematic drawing illustrating that the dice cup is disengaged from the dice seat in the dice box opening step e)
Figure 13:
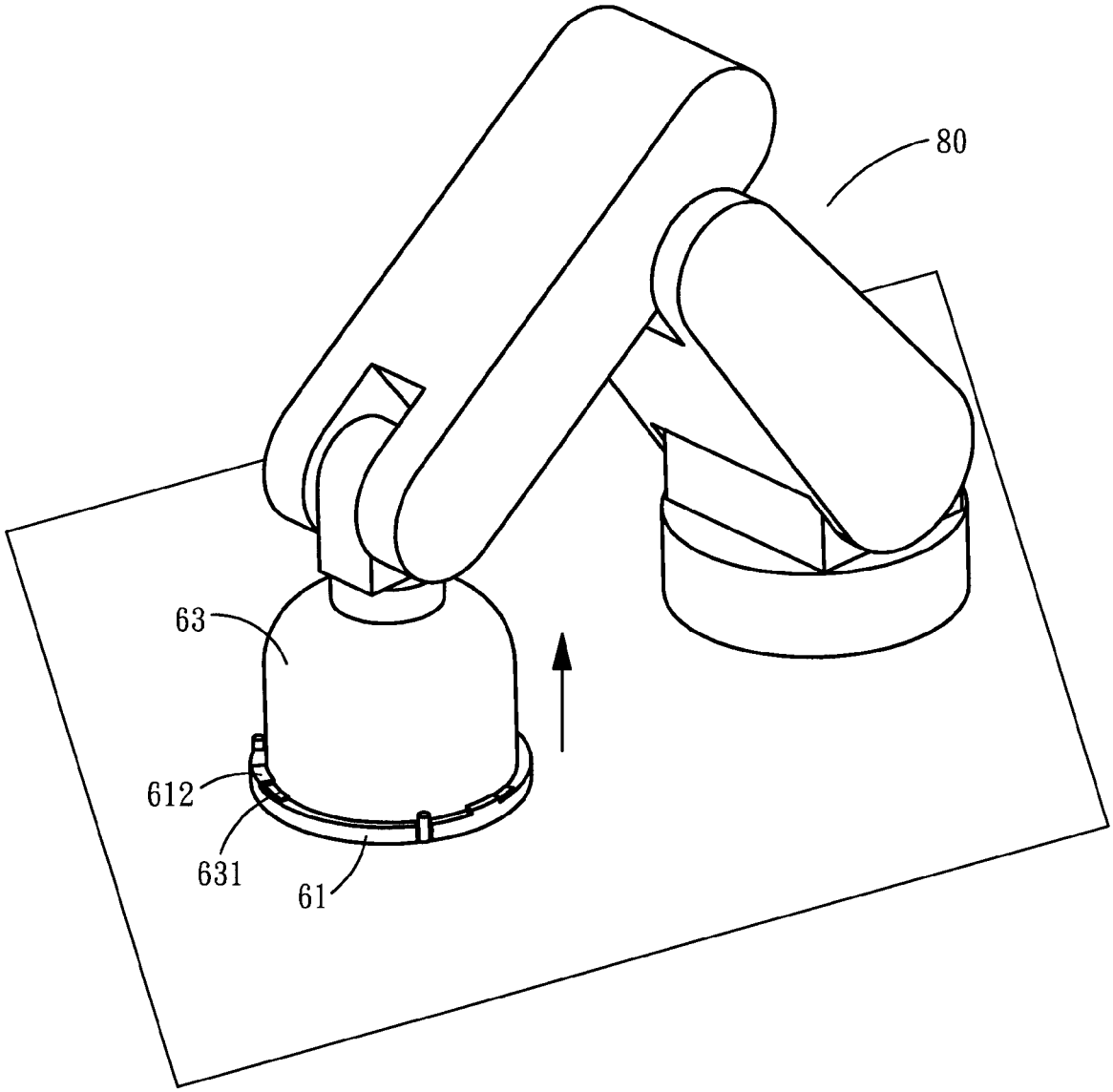
FIG. 13 is another schematic drawing illustrating that the dice cup is disengaged from the dice seat in the dice box opening step e)
Figure 14:
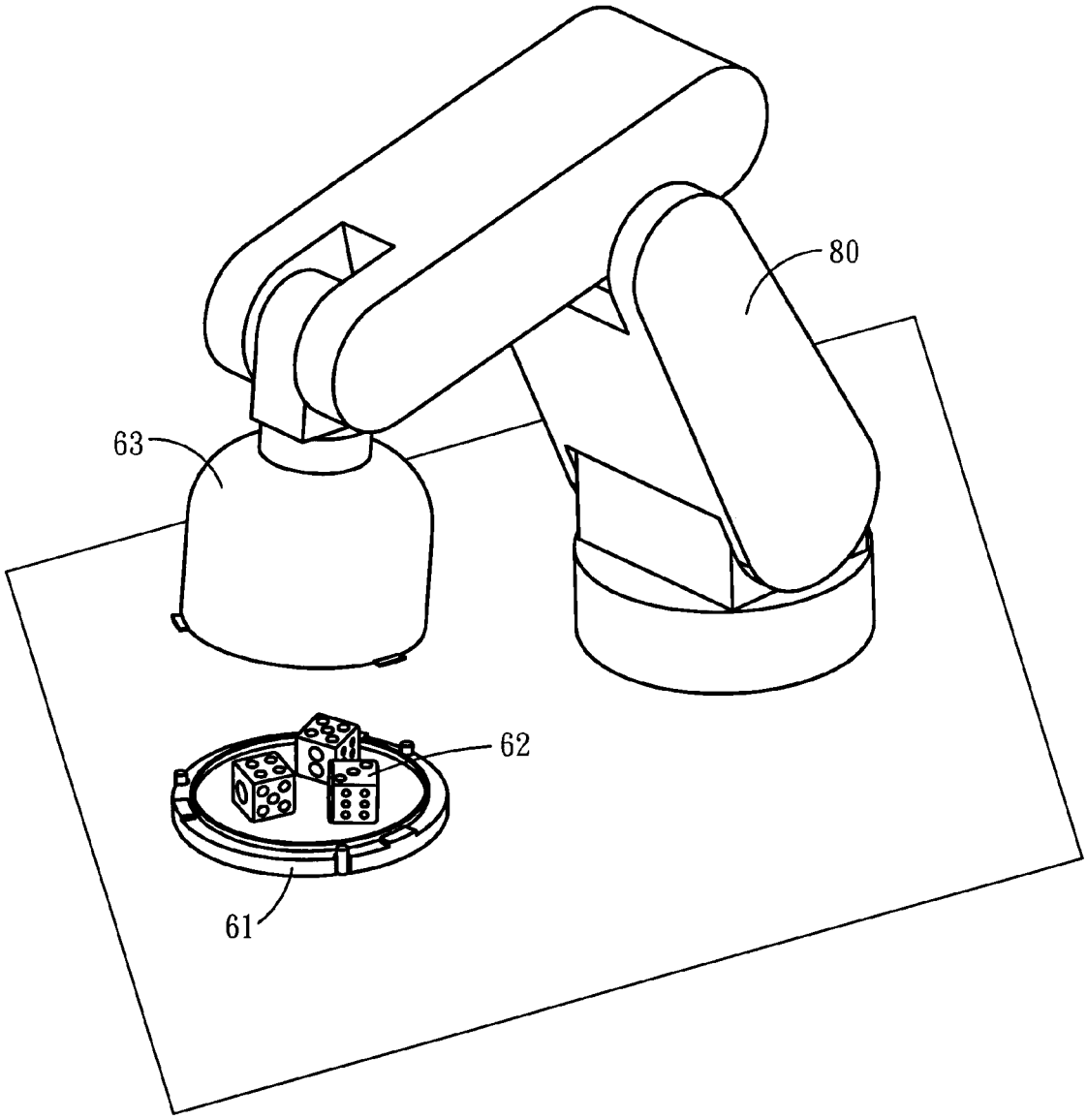
FIG. 14 is a schematic drawing illustrating that the dice cup is opened from the dice seat in the dice box opening step e).

In d) dice seat positioning step 40, as shown in FIGS. 9 and 10, the dice seat 61 of the dice box 60 is again positioned on the plane 70 in a detachable manner. More specifically, the mechanical arm 80 is controlled to move the dice box 60, forcing the three positioning grooves 611 into engagement with the three upright pins 711 respectively, finishing the positioning of the dice seat 61.

In e) dice box opening step 50, as shown in FIGS. 11-14, the mechanical arm 80 is controlled to separate the dice cup 63 from the dice seat 61, exposing the dice 62 on the dice seat 61 for enabling a recognition apparatus (not shown) to recognize the point of each of the dice 62 so that dividends can be paid subject to the betting content and a next dice shaking cycle can be started from the dice box joining step b). More specifically, the mechanical arm 80 is controlled to rotate the dice cup 63 in the reversed direction, thereby disengaging the male engagement unit 631 of the dice cup 63 from the female engagement unit 612 of the dice seat 61. Thereafter, the mechanical arm 80 is operated to carry the dice cup 63 upwardly away from the dice seat 61. Further, it is to be understood that the recognition apparatus is for automatic dice reading, and the reading result can be displayed on a display screen, read out by voice, or in both ways so that the banker and the player can know the game result. Without any recognition apparatus, the banker and the player can visually check the dice to know the game result, determining win or loss.

As stated above, when the three positioning grooves 611 are coupled to the three upright pins 711, the dice seat 61 is positioned on the plane 70 and prohibited from rotation relative to the plane 70. Therefore, the dice seat 61 is immovable when the mechanical arm 80 rotates the dice cup 63 clockwise or counter-clockwise. Thus, the dice cup 63 can be rotated relative to the dice seat 61 between an engagement position where the dice cup 63 and the dice seat 61 are engaged together and a disengagement position where the dice cup 63 is disengaged from the dice seat 61.

The above statement describes the operation steps of the automatic dice shaking method. As stated above, the dice shaking method comprises a) dice seat positioning step 10, b) dice box joining step 20, c) dice shaking step 30, d) dice seat positioning step 40 and e) dice box opening step 50. After finishing of the step of e) dice box opening step 50, the dice seat positioning step, i.e., the step of d) dice seat positioning step 40 has been done; the step of a) dice seat positioning step 10 is to be executed only at the first round. In the next and other further rounds, it starts from the step of b) dice box joining step 20.

In conclusion, the invention provides an automatic dice shaking method, which has the following features and advantages:

1. Because all actions, such as dice shaking, dice box opening, and etc., during the dice game are done through a computer-controlled mechanical arm without any labor, the method prevents a dealer from controlling the points of the dice by means of a manipulation skill and avoids presence of the points expected by the banker by means of the control of the muscular strength of the hand shaking the dice. Therefore, the invention effectively eliminates cheating and improves game fairness.

2. Because all actions, such as dice shaking, dice box opening, and etc., during the dice game are done through a computer-controlled mechanical arm without any labor, it is not necessary to hire a person for the actions of shaking the dice and opening the dice cup. Therefore, the invention helps reduce the dice game personnel cost.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An automatic dice shaking method comprising the step of:

a) detachably positioning a dice seat of a dice box on a plane, wherein a plurality of dice are placed and exposed on said dice seat of the dice box;

b) detachably joining a dice cup of said dice box to said dice seat by a mechanical arm for enabling the joined dice seat and dice cup to be moved together by said mechanical arm;

c) carrying said dice box away from said plane and shaking said dice in said dice box by said mechanical arm;

d) detachably positioning said dice seat on said plane; and e) separating said dice cup from said dice seat by said mechanical arm to have said dice be exposed at said dice seat, and enabling a next dice shaking round to be started from the step b).

2. The automatic dice shaking method as claimed in claim 1, wherein said dice cup is secured to a front end of said mechanical arm and then moved with said mechanical arm for joining to said dice seat in step b).

3. The automatic dice shaking method as claimed in claim 1, wherein said mechanical arm comprises means for catching said dice cup to join said dice cup to said dice seat in step b).

4. The automatic dice shaking method as claimed in claim 1, wherein said dice cup is joined to said dice seat by means of one of a screw joint and a clamp joint in step b).

5. The automatic dice shaking method as claimed in claim 1, wherein said mechanical arm is operated to rotate said dice cup so as to move said dice cup into engagement with said dice seat in step b).

6. The automatic dice shaking method as claimed in claim 1, wherein said mechanical arm is operated to rotate said dice cup so as to separate said dice cup from said dice seat in step e).

7. The automatic dice shaking method as claimed in claim 1, further comprising a step of reading the points of said dice by a recognition apparatus after said dice are exposed at said dice seat in step e).

* * * * *